US005673717A

United States Patent [19]

Jinbäck

[11] Patent Number: 5,673,717

[45] Date of Patent: Oct. 7, 1997

[54] FLUSHING DEVICE

[76] Inventor: Lars Henry Jinbäck, P.O. Box 2 Fränninge 23:46, S-275 21 Sjöbo, Sweden

[21] Appl. No.: 593,700

[22] Filed: Jan. 29, 1996

[30] Foreign Application Priority Data

| | | | |
|---|---|---|---|
| Jan. 30, 1995 | [SE] | Sweden | 9500301 |
| Jan. 30, 1995 | [SE] | Sweden | 9500302 |
| Jan. 30, 1995 | [SE] | Sweden | 9500303 |

[51] Int. Cl.[6] ..... B08B 9/08

[52] U.S. Cl. ..... 134/167 R; 134/169 R; 134/181; 239/240; 239/263.3

[58] Field of Search ..... 134/166 R, 167 R, 134/168 R, 168 C, 167 C, 169 C, 169 R, 166 C, 181; 239/240, 243, 263.3

[56] References Cited

U.S. PATENT DOCUMENTS

| | | | |
|---|---|---|---|
| 2,661,241 | 12/1953 | Veneziano | 134/167 R |
| 3,544,012 | 12/1970 | McNally | 239/240 |
| 3,902,670 | 9/1975 | Koller et al. | 239/240 |
| 4,407,678 | 10/1983 | Furness et al. | 134/167 R |
| 4,605,028 | 8/1986 | Paseman | 239/240 |
| 4,913,346 | 4/1990 | Nakamura et al. . | |
| 5,092,523 | 3/1992 | Rucker et al. | 239/240 |

FOREIGN PATENT DOCUMENTS

| | | | |
|---|---|---|---|
| 379291 | 8/1923 | Germany . | |
| 387519 | 1/1924 | Germany . | |
| 1009118 | 3/1957 | Germany . | |
| 1118568 | 1/1958 | Germany | 134/167 R |
| 1178253 | 3/1962 | Germany . | |
| 402261 | 6/1978 | Sweden . | |
| 445823 | 7/1986 | Sweden . | |
| 1187486 | 4/1970 | United Kingdom | 134/167 R |
| 2177591 | 1/1987 | United Kingdom . | |
| 9417922 | 8/1994 | WIPO . | |

OTHER PUBLICATIONS

Publication Stanitz/Raabe, Publish date unknown, discloses tube wheels or radial inflow.

Information Sheet, Publish date unknown, describes speed adjustment by loosening a nut on a turbine shaft and adjusting the turbine to a desired position.

Program Report Turbine Performance, unknown if published, describes losses in turbines.

Catalogue Pages from Klaus Union, publication date unknown, shows magnetic couplings for pumps.

Catalogue Pages from Vactek AB, publication date unknown, shows magnetic couplings for different uses.

*Primary Examiner*—Frankie L. Stinson

*Attorney, Agent, or Firm*—Tarolli, Sundheim, Covell, Tummino & Szabo

[57] ABSTRACT

The present invention relates to a flushing device for internal flushing of tanks, preferably tanks in vessels or ships, whereby a turbine wheel (13) in a turbine device (8) is mounted in a supply conduit (10) so that said wheel (13) is driven by the flow of flush liquid in said supply conduit (10), and whereby the turbine wheel (13) is provided to operate a driving assembly located outside the supply conduit (10) and provided to bring a flush-liquid pipe to rotate and at the same time revolve or turn flush nozzles (7). A magnetic coupling (50) is provided to transfer by means of magnetic power, the rotary motions of the turbine wheel (13) from the interior of the supply conduit (10) to the driving assembly (9) located outside said supply conduit (10). Furthermore, the turbine wheel (13) is displaceably mounted for increasing or decreasing the speed of rotation thereof.

19 Claims, 7 Drawing Sheets

FLUSHING DEVICE

The present invention relates to a flushing device for internal flushing of tanks, preferably tanks in vessels or ships, whereby at least one flush-liquid pipe is rotatably provided in the tank, whereby the flush-liquid pipe has at least one flush nozzle which is pivotally mounted relative to the flush-liquid pipe, whereby a supply conduit is provided to feed flush liquid to the flush-liquid pipe and through said pipe to the flush nozzle which is adapted to direct jets of flush liquid towards the inner sides of the tank, whereby a turbine wheel in a turbine device is mounted in the supply conduit so that said wheel is driven by the flow of flush liquid in said supply conduit and whereby the turbine wheel is provided to drive a driving assembly located outside the supply conduit and provided to bring the flush-liquid pipe to rotate and at the same time revolve or turn the flush nozzle.

At flushing devices of said type the turbine device cooperates with the driving assembly through a rotating drive means which extends out of the supply conduit through a hole in said conduit.

It is difficult to obtain an effective and long-lasting sealing at said hole between the rotating drive means and the wall of the supply conduit.

The object of the present invention has been to eliminate this drawback and this is arrived at according to the invention by providing the abovementioned flushing device with the characterizing features of subsequent claim 1.

Since the flushing device includes the magnetic coupling according to said characterizing features, it is achieved that the rotary movements of the turbine device can be transferred to the driving assembly without boring holes for rotating drive means in the walls of the supply conduit, which means that sealing problems which might arise in connection with such holes are eliminated. Since furthermore, the inner magnetic body of the magnetic coupling according to said characterizing features is located in a closed space, it is achieved that those aggressive chemicals that can flow through the supply conduit can not come in contact with the inner magnetic body so that said body is damaged.

The magnetic coupling can be combined with a turbine wheel which is movable for adjustment of the speed thereof. Hereby, a simple and reliable flushing device is obtained.

The invention will be further described below with reference to the accompanying drawings, wherein FIG. 1 with a side view and partly in section illustrates a flushing device with a device according to the invention;

Figure 1:
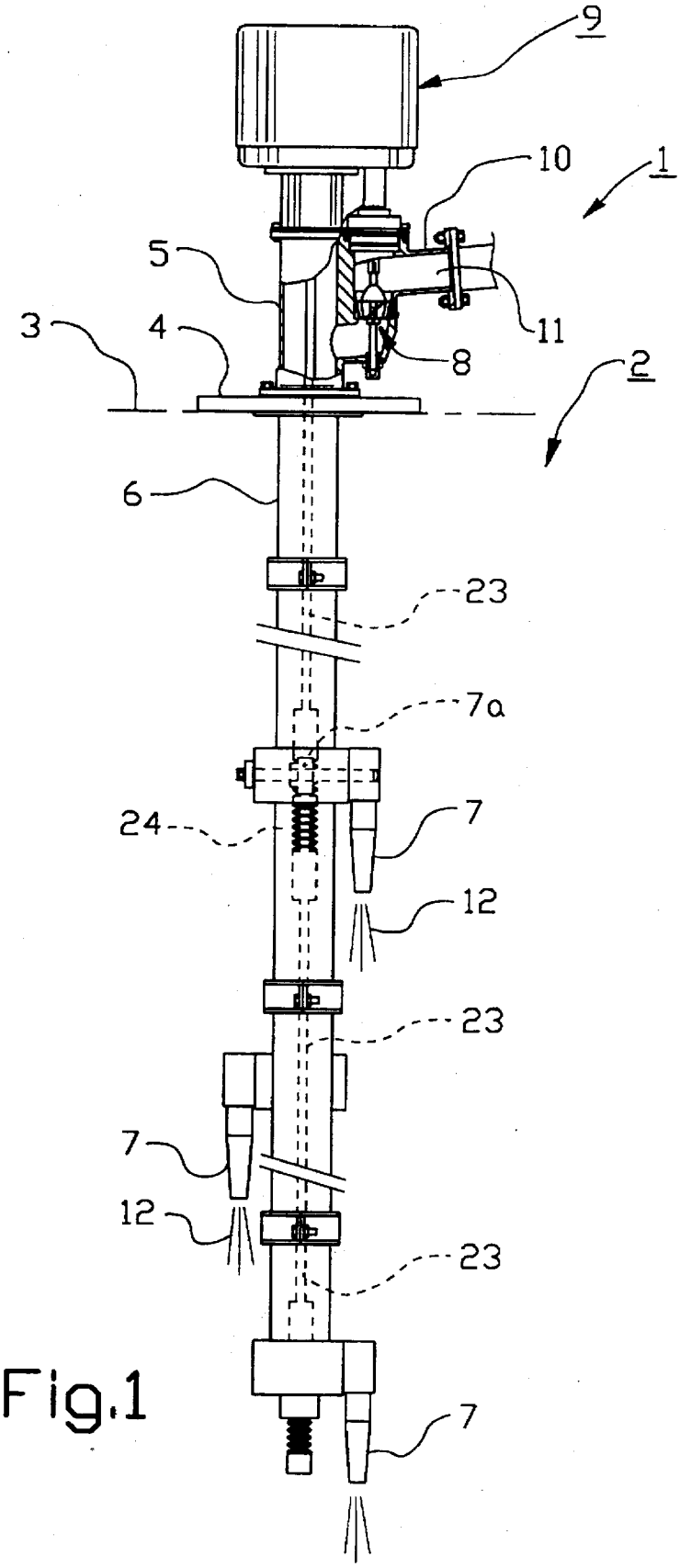
Figure 5:
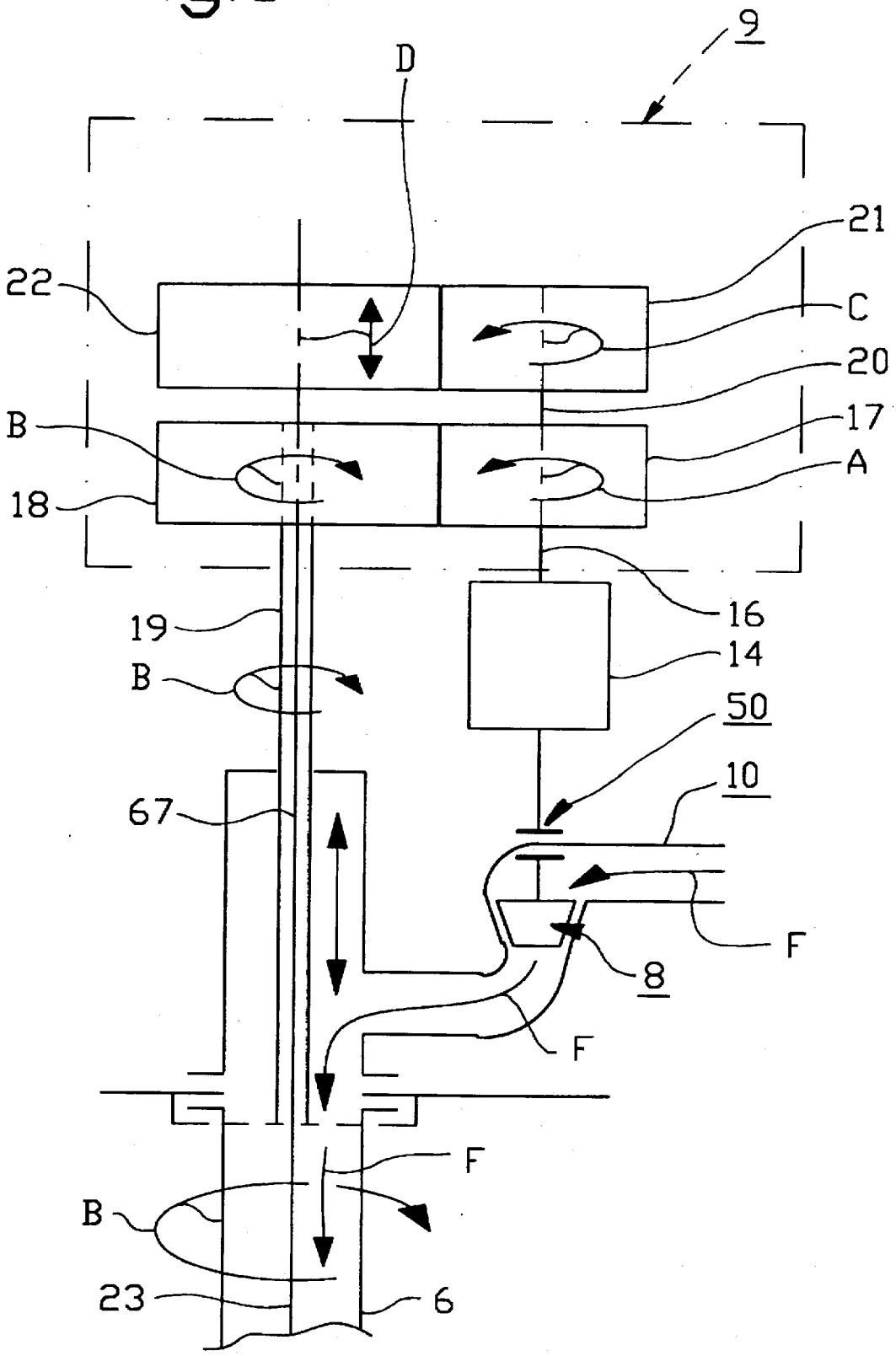
Figure 7:
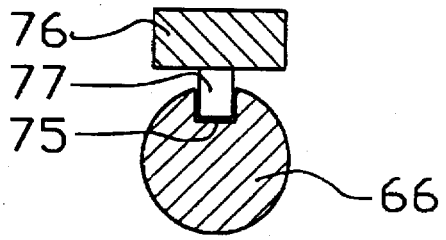
Figure 6:
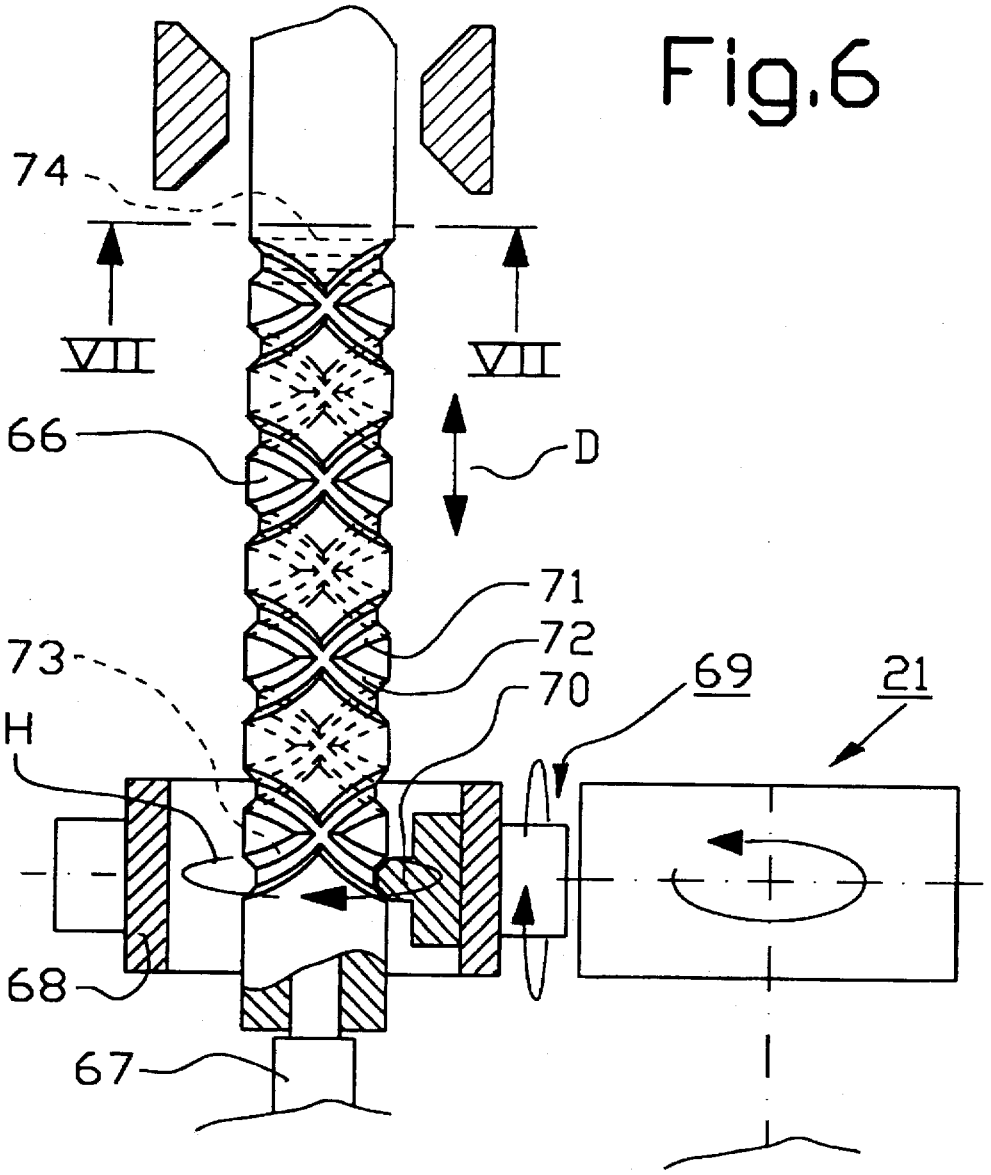
Figure 8:
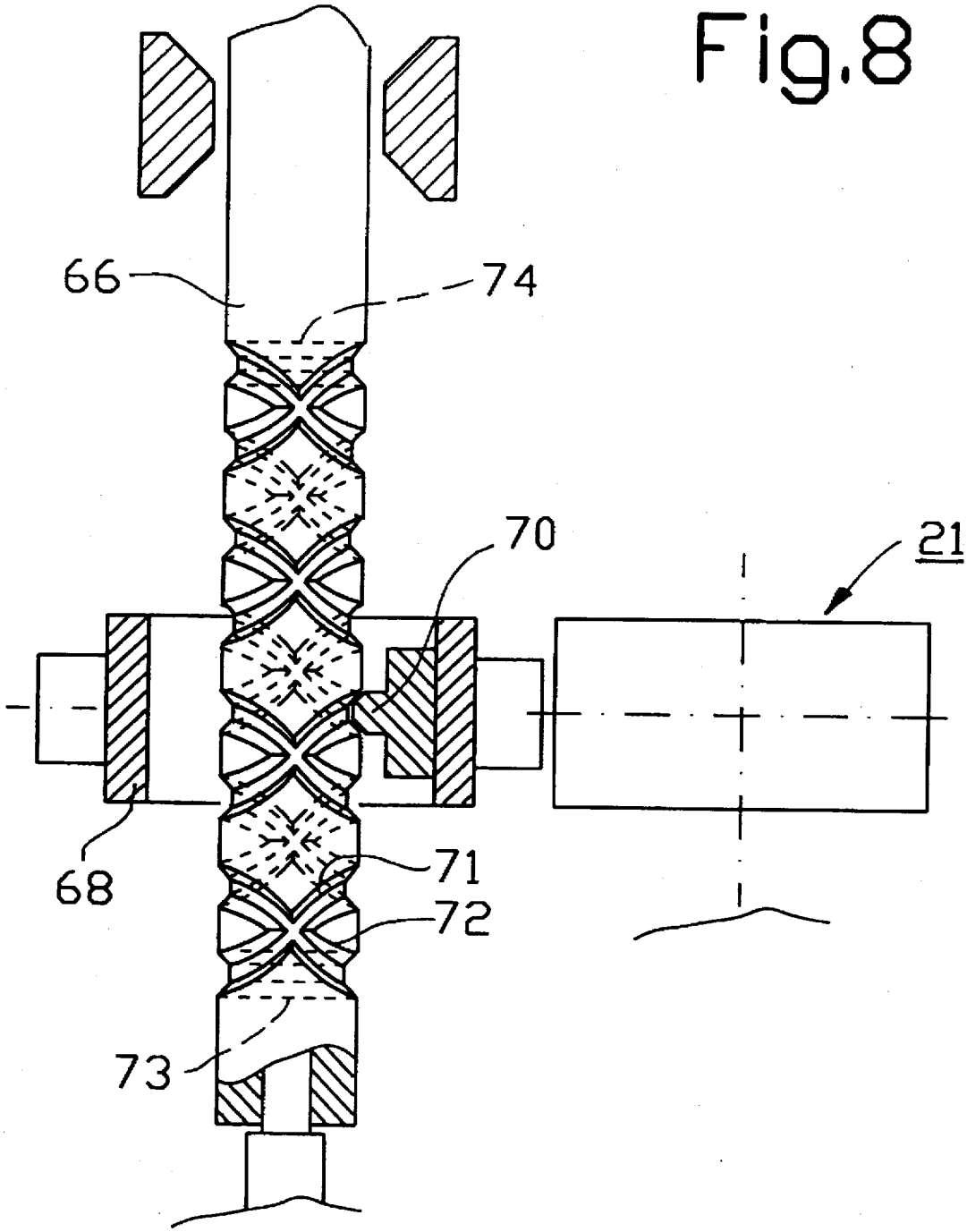

FIG. 5 schematically illustrates a driving assembly forming part of the flushing device of FIG. 1, and members connected to said assembly;

FIG. 6 schematically and partly in section illustrates members of the driving assembly according to FIG. 5;

FIG. 7 is a section VII—VII through a member forming part of the driving assembly of FIG. 6; and FIG. 8 finally, illustrates the members of the driving assembly of FIG. 6 in another position.

In the figures there is shown a flushing device 1 for internal flushing of tanks, preferably tanks 2 in vessels or ships, the upper or top side 3 of which is indicated by dashed and dotted lines in FIG. 1. The flushing device 1 has a mounting plate 4 through which it is mounted on said top side 3 of the ship's tank 2. The flushing device 1 also includes an inlet housing 5, a flush-liquid pipe 6 with flush nozzles 7, a turbine device 8 and a driving assembly 9. The inlet housing 5 is located on top of and attached to the mounting plate 4. The flush-liquid pipe 6 is rotatably mounted on the inlet housing 5 and protrudes therefrom down into the ship's tank 2 to be flushed. The flush nozzles 7 are pivotally mounted on the flush-liquid pipe 6 and adapted to revolve or turn in relation thereto while simultaneously rotating said flush-liquid pipe 6. The turbine device 8 is located in a supply conduit 10 which is adapted to feed flush liquid 11 to the flush-liquid pipe 6 and through said pipe to the flush nozzles 7 which are adapted to direct jets 12 of flush liquid towards the inner sides of the ship's tank 2.

The flow of flush liquid in the supply conduit 10 is compressed and the type of flush liquid 11 may vary in dependence of the substance which has been stored in the tank 2 to be cleaned. Thus, the flush liquid can e.g. be cold or hot water with or without additives. If the ship's tank 2 has contained oil, the flush liquid can be heated oil which is used for removing impurities on said inner sides.

The turbine device 8 includes a turbine wheel 13 which is rotated by the flush liquid 11 when said liquid flows through the supply conduit 10 to the flush-liquid pipe 6. The turbine wheel 13 is adapted to operate the driving assembly 9 located outside the supply conduit 10. The driving assembly 9 is provided to rotate the flush-liquid pipe 6 and simultaneously revolve or turn the flush nozzles 7.

The turbine wheel 13 of the turbine device 8 preferably operates a driving gear 14, preferably a planetary gearing, which is adapted to substantially gear down the speed of rotation of an input shaft 15 operated by the turbine wheel 13, e.g. with a ratio of 1:30 from said input shaft 15 to the output shaft 16 of the driving assembly 9. Thus, the speed of rotation of the input shaft 15 of about 1500 rpm in the driving gear 14 can e.g. be geared down to about 50 rpm on the output shaft 16.

The shaft 16 cooperates with a motion transfer device 17 forming part of the driving assembly 9 and transferring its rotary motion (arrow A, FIG. 5) to a rotary gear 18 for rotating the members .forming part thereof, the rotary motion of said rotating gear (arrow B, FIG. 5) being transferred through a downwardly directed motion transfer means 19 to the flush-liquid pipe 6 for rotation thereof. The motion transfer device 17 and the rotary gear 18 are only schematically illustrated, since they can be designed as a prior art device at flushing devices or in any other suitable way.

The motion transfer device 17 is also adapted to transfer its rotary motion, e.g. through an output shaft 20, to another motion transfer device 21, the rotary motion of which (arrow C, FIG. 5) is transferred to a lifting gear 22 wherein the rotary motion of a means forming part thereof is transferred to another means forming part of said lifting gear 22 such that said latter means gets a linearly reciprocating movement (arrow D, FIG. 5). The reciprocating means of the lifting gear 22 operates an elongated driving means 23 to perform reciprocating movements in the longitudinal direction thereof. This elongated driving means 23 is directed downwards into the flush-liquid pipe 6 and it has driving portions 24, preferably teeth, which cooperate with driving wheels 7*a*, preferably gear wheels, on each flush nozzle 7 so that said flush nozzle 7 is revolved or turned around a horizontal axis relative to the flush-liquid pipe 6 when the elongated driving means 23 performs reciprocating movements.

The turbine wheel 13 is displaceably mounted relative to an adjacent member 25 of the supply conduit 10. This adjacent member 25 is preferably tubular in shape. Furthermore, the turbine wheel 13 and said adjacent member 25 are designed so that the through-flow area of a through-flow space 40 which is adapted for flush liquid and which is defined between said turbine wheel 13 and said adjacent member 25 is adjusted by displacing the turbine wheel 13 relative to said adjacent member 25 and/or by displacing said adjacent member 25 relative to said turbine wheel 13. By adjusting the through-flow area, the velocity of the flow of flush liquid through said through-flow space 40 is changed and thereby the speed of rotation and/or the kinetic energy of the turbine wheel 13 as well.

This change of speed/kinetic energy of the turbine wheel 13 can be carried through while maintaining the velocity a pump system (not shown) imparts to the flush liquid 11 in the supply conduit 10 upstream of the turbine wheel 13.

The displacement of the turbine wheel 13 and/or said adjacent member 25 relative to each other is preferably a displacement in or opposite the direction of flow of the flush liquid.

In order to be able to quickly perform this individual change of the speed of rotation and/or kinetic energy of the turbine wheel 13, the displacement of said turbine wheel 13 relative to said tubular member 25 can be carried through by means of a setting device 26 which is manoeuvrable from the outer side of the supply conduit 10, i.e. it is not necessary to open the supply conduit 10 for performing said setting.

At the embodiment shown, the turbine wheel 13 can be displaceable within such a setting sector S to a position close to said adjacent member 25 or vice versa so that a low velocity of the flow of flush liquid increases locally in the through-flow space 40 from a flow velocity which is insufficient for operating the turbine wheel to a velocity which is sufficient for operating said turbine wheel 13.

At the embodiment shown, the turbine wheel 13 is mounted on a vertically directed shaft 27 and located in a vertically directed part of the supply conduit 10. A lower portion of the shaft 27 is rotatably mounted at the setting device 26 and an upper portion thereof cooperates with a means 28 for transferring the rotary motion from the turbine wheel 13 to the driving assembly 9 such that said shaft 27 is displaceable relative to said means 28 but also in driving engagement therewith for said transfer of the rotary motions. For making this possible, the shaft 27 can displaceably engage a sleeve-like member 29 of said means 28 and said shaft can include a pin 30 which displaceably engages a slot 31 provided in the sleeve-like member 29.

The turbine wheel 13 preferably consists of a hub 32 which tapers conically in the direction of flow F of the liquid 11 and a plurality of outwardly directed and on the hub preferably fixedly mounted turbine blades 33 which are oblique relative to the longitudinal axis of the turbine wheel 13 and to the direction of flow F of the flush liquid 11. Each turbine blade 33 may be planar or arcuate and said blade or parts thereof can extend at an angle of 40°–50° relative to said longitudinal axis. On the shaft 27 and in front of the hub 32 in the direction of flow F of the flush liquid 11 there is mounted a streamline nose member 34, and the hub 32 can be non-rotatably mounted on said shaft 27 by means of a pin 35 or similar mounting element.

The tubular member 25 can be a separate member which is inserted in a recess 36 therefor in the supply conduit 10 and which is retained in this position by means of at least one mounting means, e.g. a mounting screw 37, which can be screwed from the outside through the wall of the supply conduit 10 and into the tubular member 25.

Figure 3:
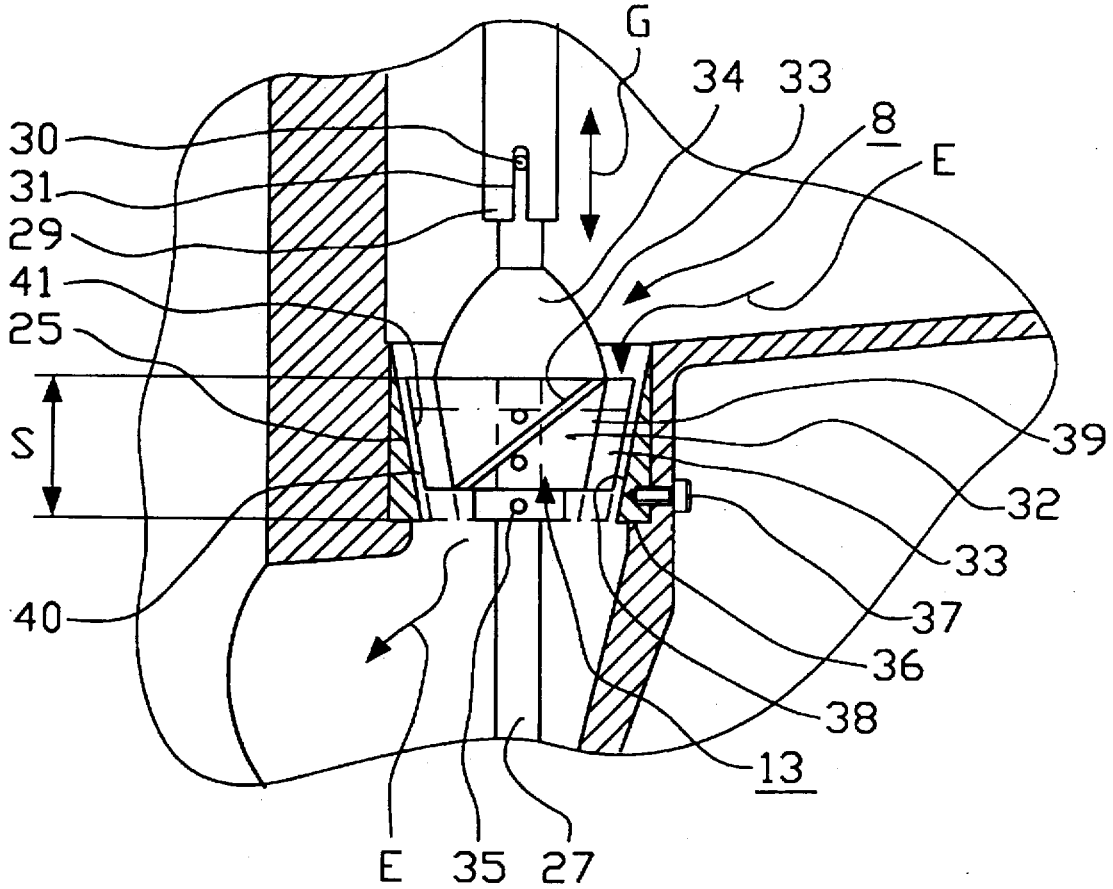
FIG. 3 illustrates portions of the supply conduit according to FIG. 2 with the turbine device in another position.
Figure 4:
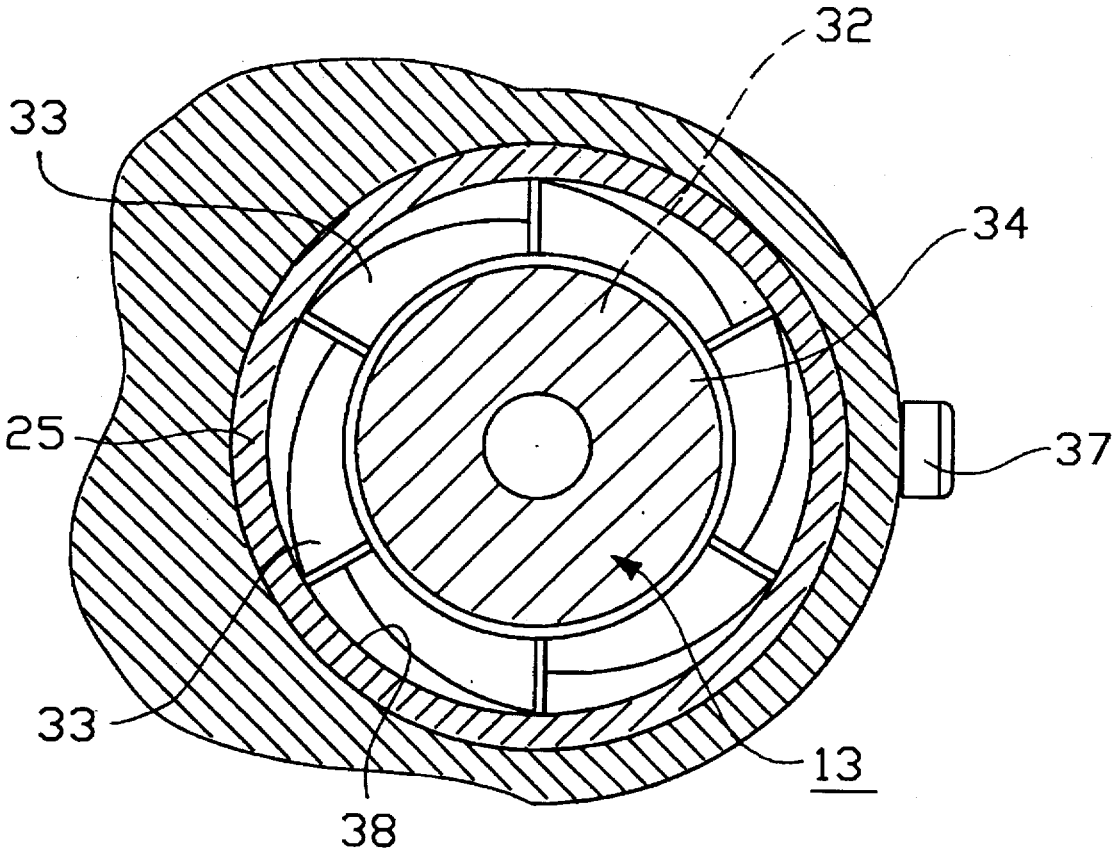
FIG. 4 is a section IV—IV through the turbine device of FIG. 3.

The tubular member 25 has inner sides 38 which taper conically in the direction of flow F of the flush liquid 11 and which preferably have the same or substantially the same conicity as outer sides 39 of the hub 32, i.e. the inner sides 38 of the tubular member 25 and the outer sides 39 of the hub 32 run in parallel or substantially in parallell with each other, whereby a through-flow space 40 of equal width or substantially equal width is defined between the outer sides 39 of the hub 32 and the inner sides 38 of the tubular member 25. Additionally, the outer edges 41 of the turbine blades 33 can, seen from the side, run in parallel or substantially in parallel with the inner sides 38 of the tubular member 25 so that the turbine wheel 13 can be set either with the outer edges 41 of the turbine blades 33 extending in their entire lengths close to said inner sides 38, whereby said turbine wheel 13 is located in an end position in said setting sector S (see FIG. 3) in which the size of the through-flow space 40 (through-flow area) is at its minimum, or in another end position substantially farther away from said inner sides 38, whereby the size of said through-flow space 40 is at its maximum.

Preferably, the turbine wheel 13 is also provided and settable in various positions within such a setting sector S such that the hub 32 in all setting positions is located inside or substantially inside the tubular member 25.

The setting device 26 includes, at the embodiment shown, a displacement means which can be set from the outer side of the supply conduit 10. This displacement means is e.g. a setting sleeve 42 which is provided with external threads 43 and which is closed at its outer end but has an open inner end. The setting sleeve 42 is screwed into a threaded hole 44 in the wall of the supply conduit 10, and on the external threads 43 thereof there is screwed a counternut 45 which secures the sleeve 42 in the position set. In the setting sleeve 42 there is preferably provided a spherical bearing element 46 which is engaged by the shaft 27 through a hard-metal body 47 located on the end surface of said shaft 27. A lock ring 48 can be located in the setting sleeve 42 in order to hold the spherical bearing element 46 in position and a radial bearing 49 for the shaft 27 can also be located in said sleeve 42.

Figure 2:
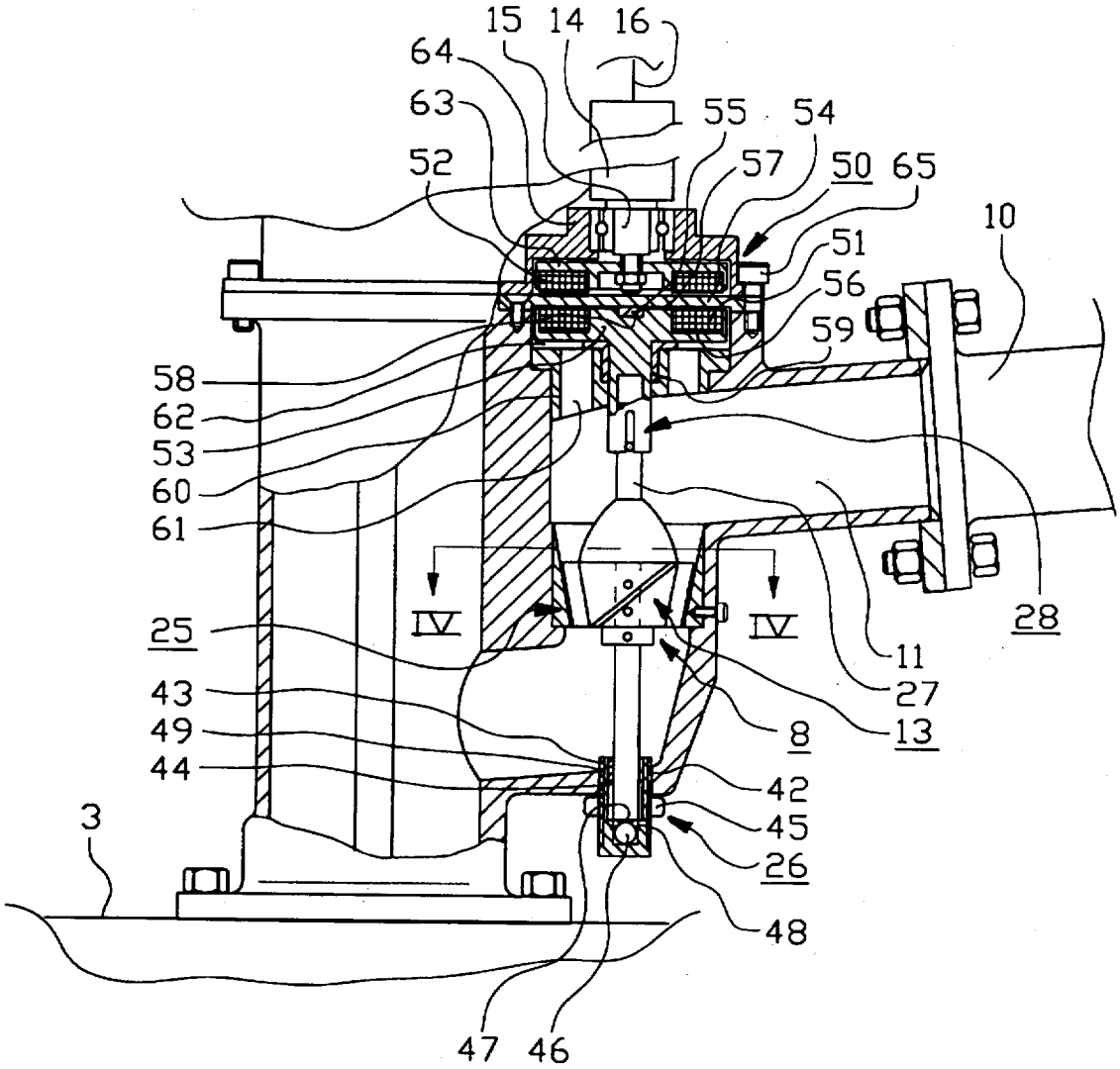
FIG. 2 is a section through a supply conduit forming part of the flusing device of FIG. 1, and a turbine device mounted in said conduit.

By screwing the setting sleeve 42 farther into the supply conduit 10 from the position in FIG. 2, the shaft 27, and thereby the turbine wheel 13, is displaced relative to the tubular member 25, whereby the size (through-flow area) of the through-flow space 40 increases. Then, the velocity of the flow E of flush liquid at the turbine wheel 13, and thereby the speed of rotation and/or kinetic energy thereof, decreases.

The tubular member 25 adjacent to the turbine wheel 13 can be designed and located otherwise and can also consist of more than one piece. Said adjacent member 25 can also be movable relative to the turbine wheel 13 instead of the opposite and it is also possible for the above purpose to provide the turbine wheel as well as the adjacent member 25 movable relative to each other.

The turbine wheel 13 can be of another type than shown and it can be located in another position in the supply conduit 10 than the position shown.

Furthermore, the setting device 26 can be designed otherwise and located in another position than the position shown.

In order to avoid boring or opening a hole in the supply conduit 10 for rotary-motion transfer means, a magnetic coupling 50 is provided for transferring by means of magnetic power the rotary motions of the turbine wheel 13 from the interior of the supply conduit 10 to the driving assembly 9 located outside said conduit.

The magnetic coupling 50 preferably includes an inner magnetic body 51 which is located inside the supply conduit 10 and an outer magnetic body 52 which is located outside said supply conduit 10.

The magnetic bodies 51, 52 are positioned in such a relationship to each other that magnetic forces generated therebetween permit transfer of the rotary motion of the magnetic body 51 to the outer magnetic body 52.

The inner and outer magnetic bodies 51, 52 are preferably permanent magnets, said magnets preferably being annular. Additionally, they can have the same or substantially the same outer and inner diameters and be centered with a common centre line extending in the axial direction of the magnetic coupling 50.

Between a retaining means 53 for retaining the inner magnetic body 51 and a closed wall portion 54 of the supply conduit 10, there is provided at least one support bearing 55 which is adapted to transfer to the closed wall portion 54 the load that the inner magnetic body 51 is subjected to in a direction towards said closed wall portion 54 by magnetic forces generated in the magnetic coupling 50.

At the embodiment shown, the support bearing 55 is mounted on the retaining means 53 radially inside the annular inner magnetic body 51.

The inner magnetic body 51 is provided in a space which is closed relative to the supply conduit 10. If the inner magnetic body 51 is provided in the retaining means 53, then said space can be a groove 56 therein. The groove 56 can be closed by means of a cap 57 which also can hold the inner magnetic body 51 in position in said groove 56. In the retaining means 53, within the groove 56, there can be provided another groove 58 for the support bearing 55, which support bearing can engage said groove 58 through a central opening in the cap 57.

The closed wall portion 54 is removably mounted on the supply conduit 10 for releasing an opening therein, through which opening the turbine device 8 and those parts of the magnetic coupling 50 which are adapted to be located within the supply conduit 10 can be inserted into and withdrawn from said supply conduit 10.

The retaining means 53 is, preferably through an axial and radial bearing element 59, mounted in a bearing sleeve 60 which is located in the supply conduit 10 between the inner magnetic body 51 and the turbine device 8.

The bearing sleeve 60 is releasably mounted in the supply conduit 10 and removable therefrom through the opening through which the inner magnetic body 51 and the turbine device 8 can be withdrawn. The bearing sleeve 60 can be provided in a space of the supply conduit 10 which at least substantially is located beside a main flow path through which flush liquid 11 flows.

The bearing sleeve 60 can preferably also have drainage holes 61 between said flow path and a space 62 for the inner magnetic body 51 so that the liquid pressure in the supply conduit 10 does not subject the bearing sleeve 60 to forces in a direction towards said inner magnetic body 51.

The outer magnetic body 52 is mounted on an outer retaining means 63 which is attached to the abovementioned shaft 15. The outer retaining means 63 is located in a mounting means 64 which is releasably mounted on the supply conduit 10 by means of screws 65 for removal during disassembly of the turbine device 8.

The inner and outer magnetic bodies 51, 52 of the magnetic coupling 50 can be of another type than described, they can be designed otherwise and they can be mounted in other ways. The magnetic bodies can e.g. be annular and one of the magnetic bodies be located within the other instead of beside each other.

The lifting gear 22 comprises a threaded member 66 which is displaceably mounted in its longitudinal direction and which through a rod 67 is connected with the elongated driving means 23. An annular element 68 is rotatably mounted around the threaded member 66 and said element 68 is through a motion transfer means 69 rotated in the direction of rotation H (see FIG. 7) by the motion transfer device 21.

A carrier 70 is mounted on the annular element 68, said carrier meshing with the threads of the threaded member 66. These include two threads 71, 72 with different thread directions, namely one thread 71 running helicoidally upwards and another thread 72 running helicoidally downwards. Said threads transcend into each other down below through the transition portion 73 and at the top through the transition portion 74, so that both threads 71, 72 together define an endless thread.

When the carrier 70 rotates around the threaded member 66, it will, because of its mesh with the endless thread 71, 72, displace the threaded member 66 and thereby the elongated driving means 23 upwards, whereby the flush nozzles 7 are revolved or turned in one direction. When the threaded member 66 has been displaced upwards a certain distance, the carrier 70 will transcend through the transition portion 73 (see FIG. 7) from meshing with the downwardly running thread 72 into engagement or meshing with the upwardly extending thread 71, whereby the carrier 70 instead will move the threaded member 66 downwards and thereby revolve or turn the flush nozzles 7 in the opposite direction. When the threaded member 66 has been displaced downwards a certain distance, the carrier 70 will transcend through the transition portion 74 from meshing with the upwardly running thread 71 into engagement or meshing with the downwardly running thread 72, whereby the carrier 70 once again will move the threaded member 66 upwards.

By means of this endless thread 71, 72 it is thus permitted that the rotary motion H of the carrier 70 in one and the same direction around the threaded member 66 can bring said member 66 to be displaced alternatively upwards and downwards without interruptions, i.e. the threaded member 66 is brought to perform a continuous reciprocating movement D.

For preventing the threaded member 66 from rotating by influence from the carrier 70, said threaded member 66 has a longitudinal keygroove 75 which is engaged by a key 77 that is mounted on the frame 76 of the lifting gear 22.

The lifting gear 22 may have another design provided that the carrier 70 during continuous rotation in one direction operates the threaded member 66 to perform reciprocating movements. Thus, the threaded member 66, the carrier 70 or means 75, 77 which prevent rotation of said threaded member 66 can be designed in another way than shown and described.

I claim:

1. A flushing device for flushing inner sides of a tank (2) with a flush liquid (11), said flushing device comprising:

at least one flush pipe (6) for directing the flush liquid (11) and which is rotatable in the tank (2), said at least one flush pipe (6) having at least one flush nozzle (7) which is located in the tank (2) and is pivotally mounted to said at least one flush pipe (6);

a supply conduit (10) for feeding the flush liquid (11) to said at least one flush pipe (6) and through said at least one pipe (6) to said at least one flush nozzle (7) which is adapted to direct the flush liquid (11) through a plurality of jets (12) towards the inner sides of the tank (2);

a turbine device (8) having a turbine wheel (13) mounted in the supply conduit (10), said wheel (13) being driven by the flow of flush liquid (11) in said supply conduit (10), the turbine wheel (13) operating a driving assembly (9) located outside the supply conduit (10), the driving assembly (9) causing said at least one flush pipe (6) to rotate and, simultaneously, said at least one flush nozzle (7) to revolve;

a magnetic coupling (50) for transferring rotary motion of the turbine wheel (13) from the interior of the supply conduit (10) to the driving assembly (9) located outside said supply conduit (10);

said magnetic coupling (50) including an inner magnetic body (51) located inside the supply conduit (10) and an outer magnetic body (52) located outside said supply conduit (10) and in such a relationship to said inner magnetic body (51) that magnetic forces generated between said magnetic bodies (51, 52) transfer rotary motion of the inner magnetic body (51) to the outer magnetic body (52);

characterized in that the magnetic coupling (50) is located at the supply conduit (10) outside the tank (2); and that the supply conduit (10) outside the tank (2) has a closed wall portion (54) which is removably mounted for releasing an opening in the supply conduit (10) outside the tank (2) through which the turbine device (8) and the inner magnetic body (51) can be inserted into and withdrawn from said supply conduit (10) outside the tank (2).

2. The flushing device according to claim 1, characterized in that the inner magnetic body (51) is mounted in a closed space relative to the supply conduit (10).

3. The flushing device according to claim 1, characterized in that the inner and outer magnetic bodies (51, 52) are permanent magnets which are annular and have substantially the same outer and inner diameters, and that said annular permanent magnets are centered with a common center line extending in an axial direction for the magnetic coupling (50).

4. The flushing device according to claim 1, characterized in that at least one support bearing (55) is located between a retaining means (53) for retaining the inner magnetic body (51) and the closed wall portion (54) of the supply conduit (10), said at least one support bearing (55) being adapted to transfer to the closed wall portion (54) the load that the inner magnetic body (51) is subjected to in a direction towards said closed wall portion (54) by magnetic forces generated in the magnetic coupling (50).

5. The flushing device according to claim 1, characterized in that the inner magnetic body (51) is located in a space having the shape of a groove (56) in a retaining means (53) for retention of said inner magnetic body (51), and that the groove (56) is closed by means of a cap (57).

6. The flushing device according to claim 5, characterized in that the inner magnetic body (51) is held in position in said groove (56) by means of the cap (57) provided on the retaining means (53).

7. The flushing device according to claim 1, characterized in that a retaining means (53) forming part of the magnetic coupling (50) and for retaining an inner magnetic body (51) located within the closed wall portion (54) of the supply conduit (10) is mounted in a bearing sleeve (60) which is located in the supply conduit (10) between the inner magnetic body (51) and the turbine device (8), that the bearing sleeve (60) forms a radial and axial bearing for the retaining means (53) through a radial and axial bearing element (59) provided thereon, that the bearing sleeve (60) is releasably mounted in the supply conduit (10) and removable therefrom through an opening through which the inner magnetic body (51) and the turbine device (8) can be withdrawn from the supply conduit (10), that the bearing sleeve (60) is provided in a space of the supply conduit (10) which at least substantially is located beside a major flow path through which flush liquid (11) flows through the supply conduit (10), and that the bearing sleeve (60) has drainage holes (61) between said flow path and a space (62) for the inner magnetic body (51).

8. A flushing device for flushing inner sides of a tank (2) with a flush liquid (11), said flushing device comprising:

at least one flush pipe (6) for directing the flush liquid (11) and which is rotatable in the tank (2), said at least one flush pipe (6) having at least one flush nozzle (7) which is located in the tank (2) and is pivotally mounted to said at least one flush pipe (6);

a supply conduit (10) located outside the tank (2) for feeding the flush liquid (11) to said at least one flush pipe (6) and through at least one pipe (6) to said at least one flush nozzle (7) which is adapted to direct the flush liquid (11) towards the inner sides of the tank (2) through a plurality of jets (12);

a turbine device (8) having a turbine wheel (13) is mounted in the supply conduit (10) outside the tank (2), said wheel (13) being driven by the flow of the flush liquid (11) in said supply conduit (10), said turbine wheel (13) operating a driving assembly (9) located outside the supply conduit (10), the driving assembly (9) causing said at least one flush pipe (6) to rotate and, simultaneously, said at least one flush nozzle (7) to revolve;

a magnetic coupling (50) for transferring rotary motion of the turbine wheel (13) from the interior of the supply conduit (10) to the driving assembly (9) located outside said supply conduit (10);

characterized in that the magnetic coupling (50) is located in the supply conduit (10) outside the tank (2);

that the turbine wheel (13) is displaceably mounted relative to an adjacent member (25) of the supply conduit (10); and that the turbine wheel (13) and said adjacent member (25) define an adjustable through-flow space (40) between said turbine wheel (13) and said adjacent member (25), said through-flow space (40) being adjusted by displacing the turbine wheel (13) relative to said adjacent member (25) or by displacing said adjacent member (25) relative to said turbine wheel (13), the velocity of the flow of the flush liquid (11) through said through-flow space (40) being changed by adjusting said through-flow space (40), a change in velocity of the flow of the flush liquid (11) causing the speed of rotation and kinetic energy of the turbine wheel (13) to change.

9. The flushing device according to claim 8, characterized in that the turbine wheel (13) has a hub (32) which tapers conically in the direction of flow (F) of the flush liquid (11) through the supply conduit (10), that the member (25) of the supply conduit (10) adjacent the turbine wheel (13) has inner sides (38) which also taper conically in the direction of flow (F) of the flush liquid (11), and that the turbine wheel (13) is displaceable relative to the adjacent member (25) in or opposite to said direction of flow (F) for increasing or decreasing the through-flow area of the through-flow space (40) located between the hub (32) and said inner sides (38) of said adjacent member (25).

10. The flushing device according to claim 8, characterized in that relative displacement between the turbine wheel (13) and the adjacent member (25) is accomplished by a setting device (26) which is maneuverable from outside of the supply conduit (10) so that said supply conduit (10) need not be opened to accomplish said displacement.

11. The flushing device according to claim 8, characterized in that the turbine wheel (13) and the adjacent member (25) can be set close to each other so that a low velocity of the flow of flush liquid (11) in the supply conduit (10) upstream of the turbine wheel (13) is increased locally in the through-flow space (40) from a flow velocity which is insufficient for operating the turbine wheel (13) to a velocity which is sufficient for operating said turbine wheel (13).

12. The flushing device according to claim 8, characterized in that said adjacent member (25) comprises a tubular member in the supply conduit (10), the turbine wheel (13) being located in said tubular member.

13. The flushing device according to claim 8, characterized in that the turbine wheel (13) includes a hub (32) with outer sides (39) which are substantially parallel with inner sides (38) of the adjacent member (25), the through-flow space (40) being defined between the outer sides (39) of the hub (32) and the inner sides (38) of the tubular member (25) to have substantially equal width throughout its axial length, that the turbine wheel (13) is located relative to the inner sides (38) of said adjacent member (25) so that outer edges (41) of turbine blades (33) of the turbine wheel (13) run substantially in parallel with said inner sides (38), that the turbine wheel (13) is displaceable relative to the inner sides (38) of the adjacent member (25) within such a setting sector (S) that the outer edges (41) of the turbine blades (33) are located either close to said inner sides (38) or substantially farther away from said inner sides (38), that the turbine wheel (13) is displaceable within the setting sector (S) that the hub (32) in all setting positions is located substantially within said adjacent member (25), and that said adjacent member (25) is a tubular member which is releasably mounted in the supply conduit (10).

14. The flushing device according to claim 8, characterized in that a setting device (26) comprises a displacement means (42) mounted on the wall of the supply conduit (10) and which is adjustable from outside the conduit (10), the displacement means (42) cooperating with the turbine wheel (13) and the adjacent member (25) such that said wheel or said member can be displaced opposite to or in the direction of flow (F) of the flush liquid (11) to change the distance between the turbine wheel (13) and said adjacent member (25).

15. The flushing device according to claim 14, characterized in that the adjustable displacement means (42) cooperates with a lower portion of a shaft (27) on which the turbine wheel (13) is mounted, that an upper portion of the shaft (27) cooperates with a means (28) for transferring the rotary motion from the turbine wheel (13) to the driving assembly (9), said shaft (27) being displaceable relative to said means (28) and in driving engagement therewith for transfer of rotary motion, said adjustable displacement means comprising a setting sleeve (42) which is screwed into the wall of the supply conduit (10) and in which the lower portion of said shaft (27) is mounted.

16. The flushing device according to claim 14, characterized in that the turbine wheel (13) is mounted on a shaft (27) which is mounted in the displacement means (42) through a spherical bearing element (46).

17. A flushing device for flushing inner sides of a tank (2) with a flush liquid (11), said flush device comprising:

at least one flush pipe (6) for directing the flush liquid (11) and which is rotatable in the tank (2), said at least one flush pipe (6) having at least one flush nozzle (7) which is located in the tank (2) and is pivotally mounted to said at least one flush pipe (6);

a supply conduit (10) located outside the tank (2) for feeding the flush liquid (11) to said at least one flush pipe (6) and through said at least one pipe (6) to said at least one flush nozzle (7) which is adapted to direct the flush liquid (11) through a plurality of jets (12) towards the inner sides of the tank (2);

a turbine device (8) having a turbine wheel (13) is mounted in the supply conduit (10), said wheel (13) being driven by the flow of the flush liquid (11) in said supply conduit (10), the turbine wheel (13) driving a driving assembly (9) located outside the supply conduit (10), the driving assembly (9) causing said at least one flush pipe (6) to rotate and, simultaneously, said at least one flush nozzle (7) to revolve;

the driving assembly (9) providing for reciprocating movement (D) of an elongated driving means (23) in a longitudinal direction, the reciprocating movement causing revolving movement of said at least one flush nozzle (7);

characterized in that the driving assembly (9) for operating the elongated driving means (23) comprises a carrier (70) which is operated by the turbine device (8) to rotate continuously in one direction of rotation (H) about a threaded member (66), the carrier (70) meshing with threads (71, 72) in said threaded member (66);

that the threaded member (66) moves in the longitudinal direction in reciprocating movements (D) in order to impart the reciprocating movements to the elongated driving means (23);

that the carrier (70) imparts the reciprocating movements to the threaded member (66) by cooperating during rotation with the threads (71, 72) of said member (66); and that the threaded member (66) has two threads (71, 72), each of said two threads having a different thread direction, said two threads endlessly transcending into one another through lower and upper transition portions (73, 74) so that the carrier (70) during its continuous rotation in said one direction (H) continuously imparts the reciprocating movements (D) to the threaded member (66).

18. The flushing device according to claim 17, characterized in that the carrier (70) is mounted on an annular element (68) which rotates around the threaded member (66).

19. Flushing device according to claim 17, characterized in that means (75, 77) is provided to prevent the threaded member (66) from rotating when the member (66) is in meshing engagement with the carrier (70).

* * * * *